US006030248A

United States Patent [19]

Dancel et al.

[11] Patent Number: 6,030,248

[45] Date of Patent: Feb. 29, 2000

[54] MECHANICAL LATCH FOR MATING PRINTED CIRCUIT BOARD CONNECTORS

[75] Inventors: Michael Dancel, Colorado Springs; Thomas M. Speirs, Canon City, both of Colo.

[73] Assignee: Hewlett-Packard Company, Palo Alto, Calif.

[21] Appl. No.: 09/182,343

[22] Filed: Oct. 29, 1998

[51] Int. Cl.[7] ..... H01R 13/627

[52] U.S. Cl. ..... 439/350; 439/345

[58] Field of Search ..... 439/350, 345, 439/296, 351, 352, 367, 368, 369, 299, 327, 328, 372, 65, 64, 67, 55, 74, 79, 357, 629, 355, 325, 358, 310, 607, 609, 610; 403/338, 341, 376, 405.1, 406.1, 379.6, 380, 302, 301, 293, 297

[56] References Cited

U.S. PATENT DOCUMENTS

| | | | |
|---|---|---|---|
| 709,400 | 9/1902 | Fitzpatrick | 403/341 |
| 4,198,024 | 4/1980 | Cavanna | 248/544 |
| 4,938,701 | 7/1990 | Herberling | 439/65 |
| 5,216,578 | 6/1993 | Zenitani et al. | 361/383 |
| 5,826,836 | 10/1998 | Gallichan et al. | 248/27.3 |

*Primary Examiner*—Paula Bradley
*Assistant Examiner*—Ross Gushi

[57] ABSTRACT

A mechanical latch for increasing the mechanical integrity of board to board interconnection. The mechanical latch adds additional retention force utilizing a rigid mechanical connection. In a first embodiment, the latch is connected to a male mating connector via two screws through adjusting slots. Once the male and female connectors are engaged, the latch can be adjusted via a thumb tab so that retaining tabs engage with the backside of the female connector. The latch is then tightened via the screws to ensure a rigid mechanical connection.

12 Claims, 3 Drawing Sheets

MECHANICAL LATCH FOR MATING PRINTED CIRCUIT BOARD CONNECTORS

FIELD OF THE INVENTION

The present invention relates generally to printed circuit boards and more particularly to a mechanical latch for mating printed circuit boards via right angle connectors.

BACKGROUND OF THE INVENTION

Printed circuit boards are oftentimes connected to other printed circuit boards. Typically, this is accomplished via male and female right angle connectors. This board to board interconnection relies upon the retention force of the electrical contacts in the right angle connectors. While this arrangement works for some applications, the mechanical stability is not sufficient for optimum operation. Movement of the boards can compromise the integrity of the interconnection.

SUMMARY OF THE INVENTION

The present invention provides a mechanical latch for increasing the mechanical integrity of the board to board interconnection. The mechanical latch adds additional retention force utilizing a rigid mechanical connection. In a first embodiment, the latch is connected to the male mating connector via two screws through adjusting slots. Once the male and female connectors are engaged, the latch can be adjusted via a thumb tab so that retaining tabs engage with the backside of the female connector. The latch is then tightened via the screws to ensure a rigid mechanical connection.

DETAILED DESCRIPTION OF THE PREFERRED EMBODIMENT

Figure 1:
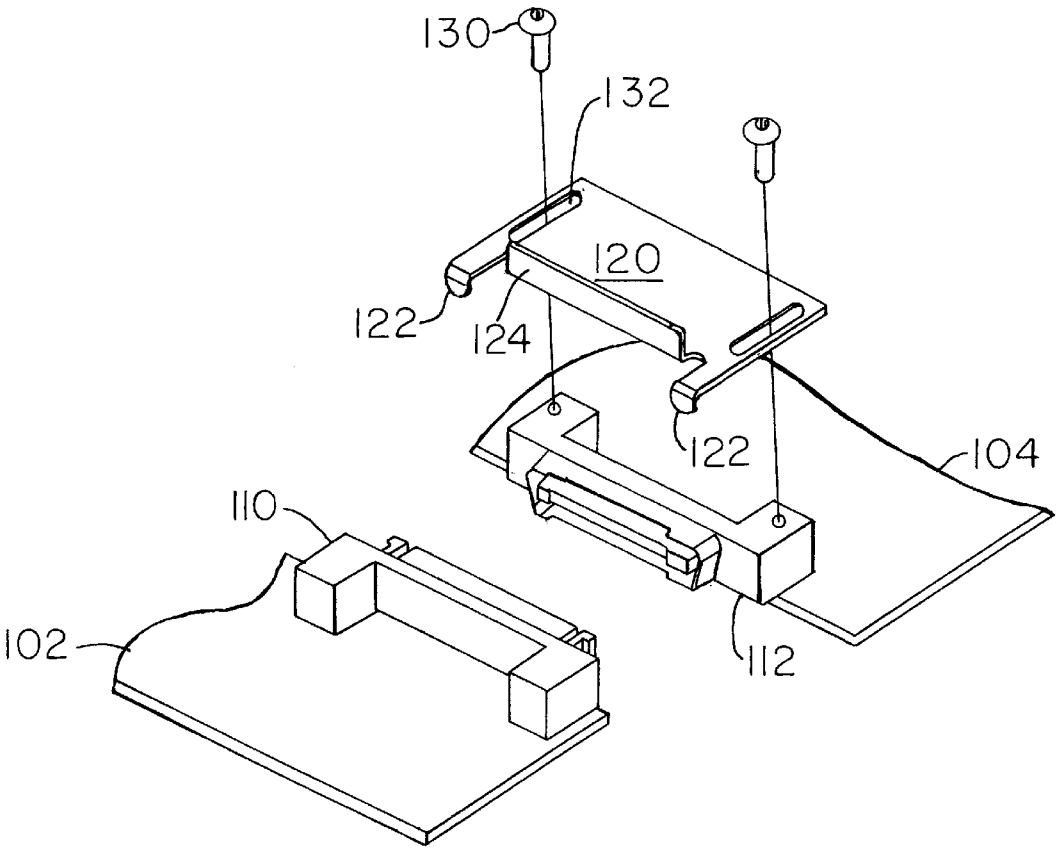
FIG. 1 shows an exploded view of the mechanical latch according to the present invention.

FIG. 1 shows an exploded view of the mechanical latch for use with male and female right angle connectors. Printed circuit boards 102 and 104 are positioned to be connected via right angle connectors. A female connector 110 is affixed to board 102; a male connector is affixed to board 104. A mechanical latch 120 having a rigid body is connected to the male connector 112 via two screws 130. Each screw 130 is passed through an adjusting slot 132, the adjusting slots 132 in the body of the latch as shown. Screws 130 are attached to the topside of the male connector 112. Retaining tabs 122 and a thumb tab 124 are provided for facilitating connection of the latch 120 to the male 112 and female 114 connectors as will be described more fully below. Retaining tabs 122 are disposed in a downward position while the thumb tab 124 is disposed in an opposite, upward position, both being generally perpendicular to the rigid body of the latch 120.

In a preferred embodiment, the male 112 and female 114 connectors are of the conventional type such as the 10150-52B2VC (male) and 10250-52B2VE (female) connectors available from 3M, St. Paul, Minn., U.S.A. The mechanical latch 120 can be made of 0.08 cm thick stainless steel with the approximate dimensions of 46×30 cm, although other materials with similar rigidity can be used. In another preferred embodiment, the mechanical latch 120 is part

#E5890-05001 available from Hewlett-Packard Company, Palo Alto, Calif., U.S.A.

Figure 2A:
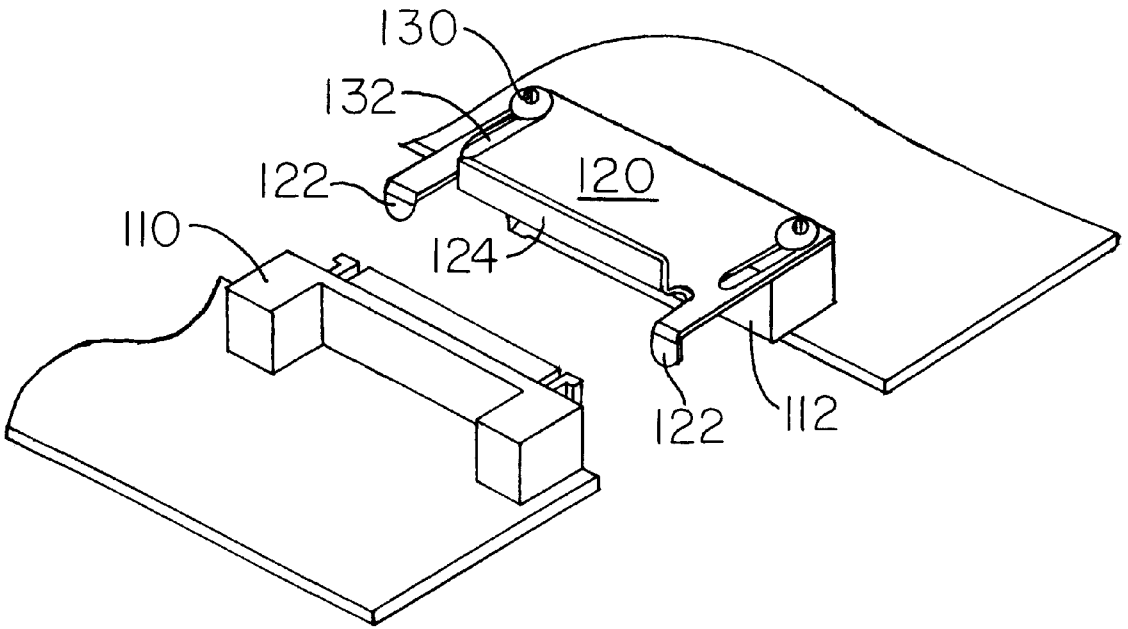
FIGS. 2*a* and 2*b* show the connectors being fastened with the mechanical latch.
Figure 2B:
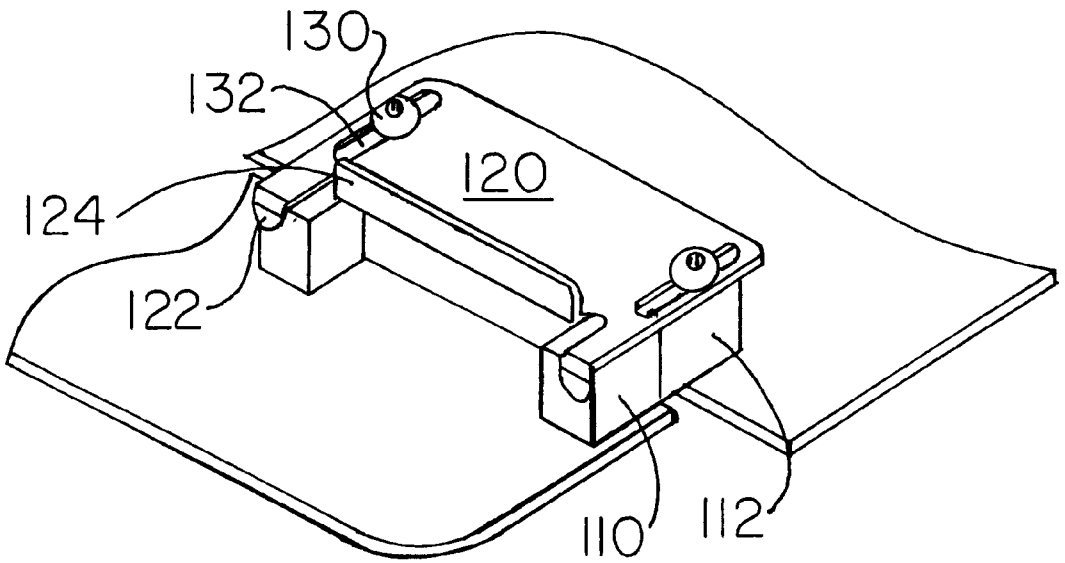

Referring now to FIGS. 2*a* and 2*b*, the screws 130 are loosened so that the latch 120 can be moved to the extended position. Grasping the thumb tab 124 and sliding the latch 120 forward effects movement of the latch 120 to allow connector placement. Retaining tabs 122 on the latch 120 engage the backside of the female connector 110 as the latch 120 is slid backward. The screws 130 are then tightened to ensure a rigid mechanical connection. In one preferred embodiment, the adjusting slots 132 are long enough to permit normal use of the connectors 112,114 with the latch 120 in the fully retracted position.

While the present invention has been illustrated and described in connection with the preferred embodiment, it is not to be limited to the particular structure shown. It should be understood by those skilled in the art that various changes and modifications may be made within the purview of the appended claims without departing from the spirit and scope of the invention in its broader aspects. For example, the mechanical latch could be used to ensure a rigid connection between two cables. Further, the latch could be attached to the female connector; in this configuration, the retaining tabs would engage the backside of the male connector.

What is claimed is:

1. A mechanical latch comprising:

a rigid body;

first and second adjusting slots disposed on the rigid body in generally spaced-apart relation;

first and second retaining tabs extending from the rigid body so that the first and second retaining tabs are generally perpendicular to the rigid body and extend generally downwardly from the rigid body; and a thumb tab located substantially laterally between the first and second retaining tabs, the thumb tab extending from the rigid body so that the thumb tab is generally perpendicular to the rigid body and extends generally upwardly from the rigid body.

2. A latch for securing together a first connector portion and a second connector portion, the first and second connector portions forming a mating connector pair, comprising:

a generally planar main body member defining a body plane, said generally planar main body having first and second elongate adjusting slots therein, said first and second elongate adjusting slots being positioned in spaced-apart relation, the first and second elongate adjusting slots being sized to receive fasteners for fastening said generally planar main body portion to the first connector portion, said generally planar main body having first and second retaining tabs extending generally downwardly from said generally planar main body so that said first and second retaining tab portions engage the second connector portion when the first and second connector portions are engaged, said first and second retaining tabs being located in generally parallel, spaced-apart relation and defining a retaining tab plane that is generally non-parallel to the body plane, said generally planar main body portion also having a thumb tab portion extending generally upwardly from said generally planar main body, said thumb tab being located substantially laterally between said first and second retaining tabs portions and defining a thumb tab plane that is also generally non-parallel to the body plane.

3. The latch member of claim 2, wherein the retaining tab plane and the thumb tab plane are located in generally parallel, spaced-apart relation.

4. The latch member of claim 2, wherein the retaining tab plane and the thumb tab plane are substantially co-planar.

5. The latch member of claim 2, wherein the retaining tab plane is perpendicular to the body plane.

6. The latch member of claim 5, wherein the thumb tab plane is perpendicular to the body plane.

7. A latch member, comprising:

a generally planar main body member having a first side, a second side, a proximal end, and a distal end, said generally planar main body member defining a body plane and first and second elongate adjusting slots therein, said first elongate adjusting slot being positioned adjacent the first side of said generally planar main body member so that said first elongate adjusting slot extends from about the proximal end of said generally planar main body member toward the distal end of said generally planar main body member and so that said second elongate adjusting slot extends from about the proximal end of said generally planar main body member toward the distal end of said generally planar main body member;

a first retaining tab located at about the first side of said generally planar main body member and extending generally downwardly from the distal end of said generally planar main body member, said first retaining tab defining a retaining tab plane;

a second retaining tab located at about the second side of said generally planar main body member and extending generally downwardly from the distal end of said generally planar main body member, the second retaining tab being substantially co-planar with the retaining tab plane; and a thumb tab extending generally upwardly from the distal end of said generally planar main body member and substantially between said first and second retaining tabs, said thumb tab defining a thumb tab plane, said thumb tab plane being non-parallel to the body plane.

8. The latch member of claim 7, wherein the retaining tab plane is substantially perpendicular to the body plane.

9. The latch member of claim 8, wherein the thumb tab plane is substantially perpendicular to the body plane.

10. The latch member of claim 9, wherein said thumb tab plane is substantially co-planar with the retaining tab plane.

11. A latch for securing together a first connector portion and a second connector portion, the first and second connector portions forming a mating connector pair, comprising:

main body means having a first side, a second side, a proximal end, and a distal end, said main body means being mountable to the first connector portion of the mating connector pair so that said main body means may be loosely mounted to the first connector portion and so that said main body means may be tightly mounted to the first connector portion;

first retaining tab means located at about the first side of said main body means for engaging the second connector portion to prevent the second connector portion from being disconnected from the first connector portion;

second retaining tab means located at about the second side of said main body means for engaging the second connector portion to prevent the second connector portion from being disconnected from the first connector portion; and thumb tab means located on said main body means at a position between said first and second retaining tab means for allowing a user to position said latch so that said first and second retaining tab means engage the second connector portion when said main body means is loosely mounted to the first connector portion.

12. A method for securing together a first connector portion and a second connector portion, the first and second connector portions forming a mating connector pair, comprising:

loosely attaching a latch to the first connector portion, the latch comprising a generally planar main body portion having a first side, a second side, a proximal end, and a distal end, the latch member also including a first retaining tab located at about the first side of the generally planar main body portion and extending generally downwardly from the distal end of the generally planar main body portion, a second retaining tab located at about the second side of the generally planar main body portion and extending generally downwardly from the distal end of the generally planar main body portion, and a thumb tab located between the first and second retaining tabs, the thumb tab extending generally upwardly from the distal end of the generally planar main body portion;

connecting the first connector portion and the second connector portion;

grasping the thumb tab on the latch to engage the first and second retaining tabs on the latch with the second connector portion; and tightly attaching the latch to the first connector portion so that the latch prevents the first and second connector portions from being disconnected.

* * * * *